US009265107B2

(12) United States Patent
Koo

(10) Patent No.: US 9,265,107 B2
(45) Date of Patent: Feb. 16, 2016

(54) LED DRIVING DEVICE, LIGHTING DEVICE AND CONTROL CIRCUIT FOR LED DRIVING DEVICE

(71) Applicant: SAMSUNG ELECTRONICS CO., LTD., Suwon-Si, Gyeonggi-do (KR)

(72) Inventor: Nam Su Koo, Yongin-Si (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 14/484,177

(22) Filed: Sep. 11, 2014

(65) Prior Publication Data

US 2015/0108915 A1 Apr. 23, 2015

(51) Int. Cl.
*H05B 33/08* (2006.01)

(52) U.S. Cl.
CPC ..... *H05B 33/0815* (2013.01); *H05B 33/0851* (2013.01)

(58) Field of Classification Search
USPC ..... 315/247, 224, 225, 185 S, 291, 307–326
See application file for complete search history.

(56) References Cited

U.S. PATENT DOCUMENTS

| | | | |
|---|---|---|---|
| 6,372,608 | B1 | 4/2002 | Shimoda et al. |
| 6,645,830 | B2 | 11/2003 | Shimoda et al. |
| RE38,466 | E | 3/2004 | Inoue et al. |
| 6,818,465 | B2 | 11/2004 | Biwa et al. |
| 6,818,530 | B2 | 11/2004 | Shimoda et al. |
| 6,858,081 | B2 | 2/2005 | Biwa et al. |
| 6,967,353 | B2 | 11/2005 | Suzuki et al. |
| 7,002,182 | B2 | 2/2006 | Okuyama et al. |
| 7,084,420 | B2 | 8/2006 | Kim et al. |
| 7,087,932 | B2 | 8/2006 | Okuyama et al. |
| 7,154,124 | B2 | 12/2006 | Han et al. |
| 7,208,725 | B2 | 4/2007 | Sherrer et al. |
| 7,288,758 | B2 | 10/2007 | Sherrer et al. |
| 7,319,044 | B2 | 1/2008 | Han et al. |
| 7,501,656 | B2 | 3/2009 | Han et al. |
| 7,709,857 | B2 | 5/2010 | Kim et al. |
| 7,759,140 | B2 | 7/2010 | Lee et al. |
| 7,781,727 | B2 | 8/2010 | Sherrer et al. |
| 7,790,482 | B2 | 9/2010 | Han et al. |
| 7,940,350 | B2 | 5/2011 | Jeong |
| 7,959,312 | B2 | 6/2011 | Yoo et al. |
| 7,964,881 | B2 | 6/2011 | Choi et al. |
| 7,985,976 | B2 | 7/2011 | Choi et al. |
| 7,994,525 | B2 | 8/2011 | Lee et al. |
| 8,008,683 | B2 | 8/2011 | Choi et al. |
| 8,013,352 | B2 | 9/2011 | Lee et al. |

(Continued)

FOREIGN PATENT DOCUMENTS

| | | | |
|---|---|---|---|
| JP | 2004-180433 | A | 6/2004 |
| KR | 93-12255 | U | 6/1993 |

(Continued)

*Primary Examiner* — Tuyet Vo
(74) *Attorney, Agent, or Firm* — McDermott Will & Emery LLP

(57) ABSTRACT

An LED driving device includes a first converter, a second converter, and a control circuit. The first converter generates a first voltage from received alternating current (AC) power. The second converter receives the first voltage and drives a plurality of LEDs based on the received first voltage. The control circuit sets a reference voltage level based on a level of the first voltage generated by the first converter, and controls the level of the first voltage by comparing a level of the AC power and a level of the reference voltage.

19 Claims, 7 Drawing Sheets

(56) References Cited

U.S. PATENT DOCUMENTS

| | | | | |
|---|---|---|---|---|
| 8,049,161 | B2 | 11/2011 | Sherrer et al. | |
| 8,129,711 | B2 | 3/2012 | Kang et al. | |
| 8,179,938 | B2 | 5/2012 | Kim | |
| 8,263,987 | B2 | 9/2012 | Choi et al. | |
| 8,324,646 | B2 | 12/2012 | Lee et al. | |
| 8,399,944 | B2 | 3/2013 | Kwak et al. | |
| 8,432,511 | B2 | 4/2013 | Jeong | |
| 8,459,832 | B2 | 6/2013 | Kim | |
| 8,502,242 | B2 | 8/2013 | Kim | |
| 8,536,604 | B2 | 9/2013 | Kwak et al. | |
| 8,648,545 | B2 * | 2/2014 | Lee et al. | 315/291 |
| 8,692,477 | B1 * | 4/2014 | Lee | 315/247 |
| 8,735,931 | B2 | 5/2014 | Han et al. | |
| 8,766,295 | B2 | 7/2014 | Kim | |
| 2004/0100740 | A1 | 5/2004 | Iwashita | |
| 2010/0013409 | A1 | 1/2010 | Quek et al. | |
| 2011/0115770 | A1 * | 5/2011 | Seo et al. | 345/211 |

FOREIGN PATENT DOCUMENTS

| | | | |
|---|---|---|---|
| KR | 94-23655 | U | 10/1994 |
| KR | 10-2006-0086596 | A | 8/2006 |
| KR | 10-2011-0015662 | A | 2/2011 |
| KR | 10-2011-0100785 | A | 9/2011 |

* cited by examiner

LED DRIVING DEVICE, LIGHTING DEVICE AND CONTROL CIRCUIT FOR LED DRIVING DEVICE

CROSS-REFERENCE TO RELATED APPLICATION

This application claims the benefit of Korean Patent Application No. 10-2013-0125929 filed on Oct. 22, 2013, with the Korean Intellectual Property Office, the disclosure of which is incorporated herein by reference.

BACKGROUND

The present disclosure relates to a Light Emitting Diode (LED) driving device, a lighting device, and a control circuit for an LED driving device.

Light Emitting Diodes (LEDs) are widely used as light sources due to various advantages they present such as low power consumption, high degree of luminance, and the like. In particular, light emitting devices have recently been employed in backlight units of general lighting devices and in large Liquid Crystal Displays (LCDs). In general, light emitting devices are provided as packages that can be easily installed in various devices such as lighting devices, and the like. As LEDs are increasingly being used for illumination in various fields, the compatibility of the LEDs with existing lighting fixture sockets and fittings has emerged as an important issue to ensure that the LEDs can be readily used to substitute existing lighting devices.

SUMMARY

An aspect of the present disclosure may provide an LED driving device allowing for an LED lighting device to be applied to facilities accommodating existing lighting fixtures such as fluorescent lamps, incandescent lamps, and the like, without modification thereof.

According to an aspect of the present disclosure, an LED driving device may include a first converter, a second converter, and a control circuit. The first converter generates a first voltage from received alternating current (AC) power. The second converter receives the first voltage and drives a plurality of LEDs based on the received first voltage. The control circuit sets a reference voltage level based on a level of the first voltage generated by the first converter, and controls the level of the first voltage by comparing a level of the AC power and a level of the reference voltage.

The control circuit may include a detection circuit generating a sensing voltage corresponding to the level of the AC power by detecting a current flowing through an inductive element in the first converter; a reference voltage control circuit determining the level of the reference voltage based on the first voltage; and a comparison circuit comparing the level of the reference voltage with a level of the sensing voltage.

The reference voltage control circuit may decrease the level of the reference voltage if the level of the first voltage increases, and increase the level of the reference voltage if the level of the first voltage decreases.

The comparison circuit may control the first voltage by controlling a duty ratio of a switching element connected to the inductive element based on a result of comparing the reference voltage and the sensing voltage.

The reference voltage control circuit may maintain the reference voltage at a constant level when the level of the first voltage is higher than a first threshold voltage level, and may increase the reference voltage when the level of the first voltage is lower than a second threshold voltage level.

The reference voltage control circuit may control the reference voltage according to the level of the first voltage when the level of the first voltage is lower than the first threshold voltage level and higher than the second threshold voltage.

The control circuit may be included in the first converter.

The first converter may be a constant current converter and the second converter may be a buck converter.

According to another aspect of the present disclosure, a lighting device may include a power source, a lighting unit, a power converter, a control circuit. The power source generates an alternating current (AC) power. The lighting unit has a plurality of LEDs. The power converter generates a first voltage for driving the plurality of LEDs by using the AC power. The control circuit determines a reference voltage based on the first voltage and controls the first voltage by comparing a level of the reference voltage and a voltage level of the AC power.

The control circuit may decrease the level of the reference voltage when the level of the first voltage increases, and increase the level of the reference voltage when the level of the first voltage decreases.

The control circuit may control the level of the first voltage by controlling a duty ratio of a switching element of the power converter based on a result of comparing a voltage level of the AC power and the reference voltage.

The control circuit may include a detection circuit generating a sensing voltage corresponding to the level of the AC power by detecting a current flowing through an inductive element in the converter; a reference voltage control circuit determining the level of the reference voltage based on the first voltage; and a comparison circuit comparing the levels of the reference voltage and the sensing voltage.

The reference voltage control circuit may include a switching element determining the reference voltage, and the switching element may be operated by the first voltage.

The reference voltage control circuit may include a resistor connected to an input terminal of the switching element, and the reference voltage may be determined according to a value of the resistor.

The power source may include a dimmer; and a ballast stabilizer for a fluorescent lamp, connected to the dimmer and generating the AC power.

According to another aspect of the present disclosure, a control circuit of an LED driving device driving a plurality of LEDs by receiving an output from a ballast stabilizer for a fluorescent lamp may include a detection circuit, a reference voltage control circuit, and a comparison circuit. The detection circuit generates a sensing voltage corresponding to an output of the ballast stabilizer for a fluorescent lamp by detecting a current flowing through an inductive element included in the LED driving device. The reference voltage control circuit determines a reference voltage based on a first voltage generated by the LED driving device. The comparison circuit controls the first voltage by comparing the sensing voltage and the reference voltage.

The comparison circuit may control an operation of a switching element connected to the inductive element responsive to a comparison of the sensing voltage and the reference voltage.

When the first voltage increases, the control circuit may decrease the current supplied to the plurality of LEDs by decreasing a duty ratio of the switching element by decreasing the reference voltage, and when the first voltage decreases, the control circuit may increase the current supplied to the plurality of LEDs by increasing the duty ratio of the switching element by increasing the reference voltage.

The switching element may include a gate terminal connected to an output terminal of the comparison circuit, a drain terminal connected to the inductive element, and a source terminal connected to an output terminal of the detection circuit.

The reference voltage control circuit may include a switching element having a common terminal, an input terminal, and an output terminal; a Zener diode, wherein the first voltage is applied to an anode thereof and a cathode thereof is connected to the common terminal of the switching element; a voltage distribution circuit having a first distribution resistor connected between the output terminal of the switching element and a predetermined first voltage source, and a second distribution resistor connected between the output terminal of the switching element and a ground terminal; and a resistor connected between the input terminal of the switching element and a predetermined second voltage source.

The reference voltage control circuit may determine the reference voltage according to the value of the resistor connected between the input terminal of the switching element and the predetermined second voltage source.

When the first voltage is higher than a predetermined threshold voltage level, the reference voltage control circuit may determine a voltage applied to the second distribution resistor as the reference voltage.

By comparing a variable reference voltage determined by an output voltage of a converter connected to a facility for a fluorescent lamp and a voltage corresponding to an output of the facility for a fluorescent lamp, and controlling an operation of the converter thereby, an LED driving device compatible with various types of lighting devices for a fluorescent lamp may be provided.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
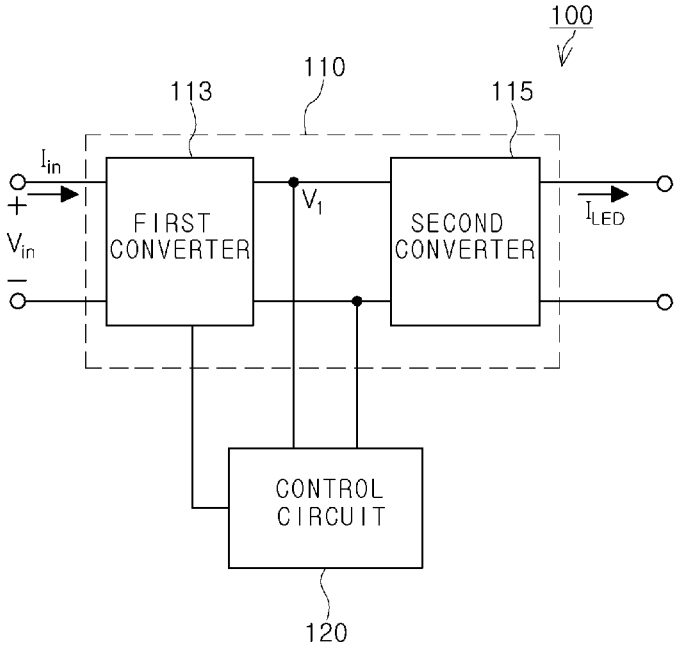
FIG. 1 is a block diagram schematically illustrating an LED driving device according to an exemplary embodiment of the present disclosure.

Hereinafter, exemplary embodiments of the present disclosure will be described in detail with reference to the accompanying drawings.

The disclosure may, however, be exemplified in many different forms and should not be construed as being limited to the specific exemplary embodiments set forth herein. Rather, these exemplary embodiments are illustrative and provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

FIG. 1 is a block diagram schematically illustrating an LED driving device according to an exemplary embodiment of the present disclosure.

Referring to FIG. 1, an LED driving device 100 according to an exemplary embodiment of the present disclosure may include a first converter 113, a second converter serially connected to the first converter 113, and a control circuit 120. The first converter 113 and the second converter 115 may be included in a power converter 110. One or more lighting elements may be connected to output terminals of the second converter 115, and the one or more lighting elements may be operated by a current signal $I_{LED}$ output from the terminals of the second converter 115. The one or more lighting elements may be provided as a package-type device including an LED.

According to the exemplary embodiment of the present disclosure, the first converter 113 may be a constant current type boost converter that generates a voltage $V_1$ that is transmitted to the second converter 115 by using a voltage $V_{in}$ and a current $I_{in}$ that are applied to input terminals of the first converter 113. The voltage $V_{in}$ applied to the input terminals of the first converter 113 may be a direct current signal, such as a rectified voltage signal output by a rectifier. To operate as a constant current type, the first converter 113 may detect a level of the voltage $V_{in}$, and generate a proper compensation value $V_1$ at its output by comparing the level of the voltage $V_{in}$ with a predetermined reference level.

The level of voltage $V_1$ which the first converter 113 transmits to the second converter 115 may be varied according to the voltage $V_{in}$ and current $I_{in}$ applied to the input terminal of the first converter 113. In turn, the current $I_{LED}$ output by the second converter 115 and operating one or more LEDs may be determined based on the level of voltage $V_1$ input to the second converter 115. In order for the LED driving device 100 according to the present exemplary embodiment to be operative to drive a wide range of lighting devices having different specifications, the first converter 113 is generally configured to stably generate an output voltage $V_1$ within the same voltage range as the voltage range of the input voltage $V_{in}$. Additionally, the output voltage $V_1$ produced by the first converter 113 should satisfy a condition in which the second converter 115 may generate the current $I_{LED}$ being able to stably operate the one or more LEDs.

The LED driving device 100 according to the present exemplary embodiment may be included in a lighting device together with a light emitting unit having a plurality of LEDs and applied to existing lighting facilities (e.g., lighting fixtures or lighting systems) installed in buildings, streetlights, vehicles, and the like. The characteristics of the voltage $V_{in}$ received from existing lighting facilities installed in diverse fields of application depend on the specification of each lighting facility. It is very difficult to individually provide an LED driving device optimized to the specification of each lighting facility. Therefore, the present exemplary embodiment can advantageously provide an LED driving device 100 which can be generally applied to diverse types of lighting facilities having different specifications to be stably operated, and a lighting device including the same.

Meanwhile, in an exemplary embodiment of the present disclosure, the second converter 115 may be a buck converter. For the second converter 115 to properly operate, the voltage $V_1$ received at an input of the second converter 115 may need to have a sufficient level so as to charge a capacitor included in the second converter 115, the minimum voltage level being defined as a lower threshold voltage $V_{th2}$. In addition, an upper threshold voltage $V_{th1}$ may be set in consideration of the stress applied to the second converter 115, one or more LEDs, or the like when an excessive voltage is applied thereto.

According to the present exemplary embodiment, the control circuit 120 included in the LED driving device 100 together with the power converter 110 may control operation of the first converter 113 by detecting the input voltage $V_{in}$ and the output voltage $V_1$ of the first converter 113. As explained above, each lighting facility to which the LED driving device 100 may be applied has a unique specification, and operational characteristics of the power converter 110 may be changed according to the specification of each lighting facility. To be widely applied to lighting facilities having various specifications, in the LED driving device 100 according to the present exemplary embodiment, the control circuit 120 controls current output from the converter 100 to the plurality of LEDs by using the input voltage $V_{in}$ and the output voltage $V_1$. Although the control circuit 120 is depicted to be separated from the power converter 110 and the first converter 113 in FIG. 1, the present inventive concept is not limited thereto. The control circuit 120 may be included in the power converter 110, or may be included inside the first converter 113.

The control circuit 120 may include a detection circuit detecting a current flowing through an inductive element included in the power converter 110, a reference voltage control circuit determining a reference voltage based on the output voltage $V_1$ of the first converter 113, and a comparison circuit comparing the levels of the reference voltage and a sensing voltage.

The detection circuit detects a current flowing through an inductive element included in the power converter 110, and converts the detected current into the sensing voltage. In this case, the input voltage $V_{in}$ may be applied to the inductive element included in the power converter 110, and the sensing voltage generated by the detection circuit may correspond to the input voltage $V_{in}$ applied to the power converter 110. In a case in which the comparison circuit includes an operational amplifier (OP-AMP), the sensing voltage generated by the detection circuit may be applied to one of input terminals of the operational amplifier. The reference voltage output from the reference voltage control circuit may be applied to another input terminal of the operational amplifier.

The reference voltage control circuit may include an adding circuit generating the reference voltage by adding a fixed voltage having a constant value and a variable voltage determined by the output voltage $V_1$ of the first converter 113. The reference voltage control circuit may decrease the reference voltage if the level of $V_1$ increases, and increase the reference voltage if the level of $V_1$ decreases. The output terminal of the comparison circuit may be connected to a control terminal of a switching element, an input terminal of the switching element may be connected to an inductive element included in the power converter 110, and an output terminal of the switching element may be connected to the detection circuit. The comparison circuit may control a duty ratio of the switching element by comparing the sensing voltage corresponding to a current flowing through a plurality of LEDs and the reference voltage. The operation of the first converter 113 may be controlled by controlling the duty ratio of the switching element.

Figure 2:
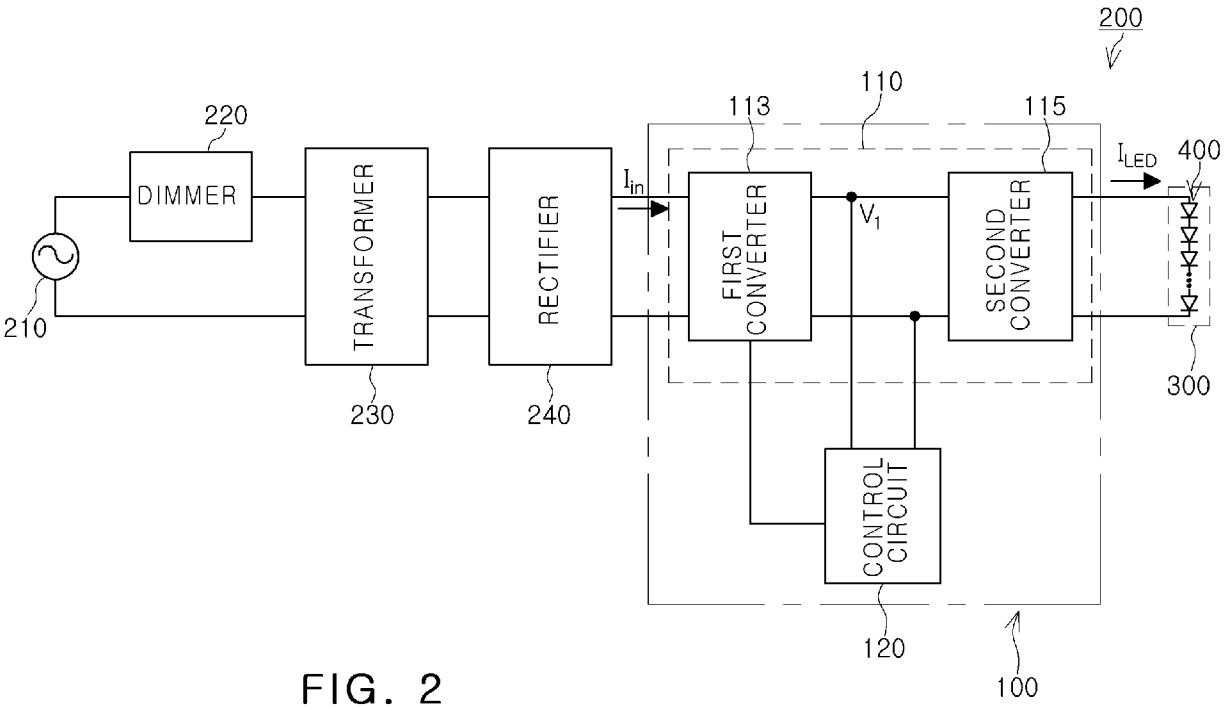
FIG. 2 is a block diagram schematically illustrating a lighting device comprising an LED driving device according to an exemplary embodiment of the present disclosure.

FIG. 2 is a block diagram schematically illustrating a lighting device according to an exemplary embodiment of the present disclosure.

With reference to FIG. 2, a lighting device 200 according to the present exemplary embodiment may comprise an LED driving device 100 including the first converter 113, the second converter 115, and the control circuit 120; a light emitting unit 300 including a plurality of light emitting devices 400; an alternating current (AC) power source 210; a dimmer 220; a transformer 230; a rectifier 240 and the like. The plurality of light emitting devices 400 may each be provided as a package-type device including one or more LEDs.

As described with reference to FIG. 1, the first converter 113 and the second converter 115 may be serially connected. The control circuit 120 may be installed separately from the power converter 110, or may be included in the power converter 110 together with the first and second converters 113 and 115. Meanwhile, the control circuit 120 may be included in the first converter 113. The control circuit 120 may control the operation of the first converter 113 by detecting the input Voltage $V_{in}$ or input current $I_{in}$ and the output voltage $V_1$ of the first converter 113.

According to the present exemplary embodiment, the control circuit 120 may include a detection circuit, a reference voltage control circuit, and a comparison circuit. The reference voltage control circuit may include an adding circuit generating a reference voltage by adding a constant voltage having a fixed value and a variable voltage determined by the output voltage $V_1$ of the first converter 113. The reference voltage control circuit may include a switching element operated by having an output voltage $V_1$ of the first converter 113 input through a Zener diode. The switching element may operate in a linear mode when a level of the voltage $V_1$ is within a predetermined range, and may determine a level of reference voltage input to the comparison circuit by controlling a level of the variable voltage according to a level of the output voltage $V_1$ of the first converter 113.

The comparison circuit may control the duty ratio of the switching element connected to an output terminal of the comparison circuit based on results from a comparison of the levels of the reference voltage and the driving voltage. As explained above, the control terminal of the switching element may be connected to an output terminal of the comparison circuit, and the input and output terminals of the switching element may be connected to an inductive element of the first converter 113 and the detection circuit, respectively.

The detection circuit may generate a sensing voltage by detecting a current transmitted through the inductive element of the first converter 113, wherein the detected current is determined by an input current $I_{in}$. Accordingly, the detection circuit may generate a sensing voltage corresponding to alternating current (AC) power generated by the dimmer 220 and the transformer 230 and provided at an input of the first converter 113. The switching element connected to the output terminal of the comparison circuit may be turned on or turned off by an output of the comparison circuit. The comparison circuit may increase the output voltage $V_1$ of the converter 113 by increasing the duty ratio of the switching element connected to the output terminal, or may decrease the output voltage $V_1$ of the converter 113 by decreasing the duty ratio of the switching element connected to the output terminal.

The AC power source 210 may be a commercial alternating current (AC) power source. The dimmer 220 is a device provided to enable users to control luminescence of light emitted from the light emitting unit 300, and may be a trailing edge type or a leading edge type of dimmer. The transformer 230 may be an electronic type or an externally exciting type transformer, and may produce an output by stepping down the alternating signal passing through the dimmer 220. The rectifier 240 may include a diode bridge and the like, and a direct current rectified by the rectifier 240 may be input to the first converter 113.

The light emitting unit 300 as illustrated in FIG. 2 may include a plurality of light emitting devices 400 and a substrate on which the plurality of light emitting devices 400 are mounted. The plurality of light emitting devices 400 may include an LED chip, a lens, a fluorescent substance, a packaging unit, and the like.

Figure 3:
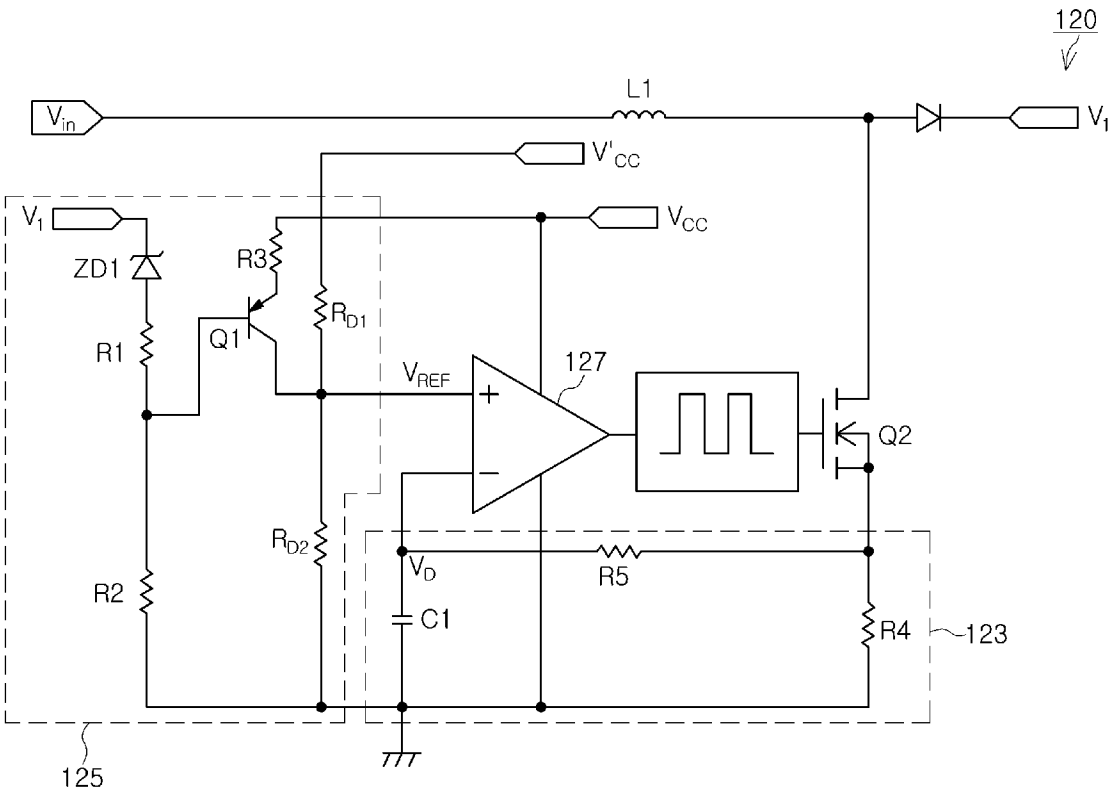
FIG. 3 is a circuit diagram schematically illustrating the operation of a control circuit unit according to an exemplary embodiment of the present disclosure.

FIG. 3 is a circuit diagram schematically illustrating a control circuit according to an exemplary embodiment of the present disclosure.

With reference to FIG. 3, the control circuit 120 according to the present exemplary embodiment may include a detection circuit 123 generating a sensing voltage $V_D$ by detecting a current flowing through an inductive element L1, a reference voltage control circuit 125 determining a reference voltage $V_{REF}$ by using a voltage $V_1$ output from the first converter 113, and a comparison circuit 127 controlling the operation of a switching element Q2 by comparing the reference voltage $V_{REF}$ and the sensing voltage $V_D$. The circuit structure of the control circuit 120 as illustrated in FIG. 3 is an exemplary embodiment of the present disclosure, and is not limited thereto. In addition, although the control circuit 120 is illustrated as being applied to the first converter 113 having a boost-converter type converter in FIG. 3, the first converter 113 according to the present exemplary embodiment is not limited to a boost-converter type converter.

The operation of the first converter 113 will be explained with reference to FIG. 3. When a voltage $V_{in}$ is applied through an input terminal, and the switching element Q2 is turned on, energy is accumulated in the inductive element L1 due to the current flowing through L1. When the switching element Q2 is turned off, the output voltage $V_1$ of the first converter 113 takes on a value based on a sum of the voltage $V_{in}$ and a voltage across L1 due to the energy accumulated in L1. The output voltage $V_1$ is transmitted to the second converter 115.

The output voltage $V_1$ is determined by the input voltage $V_{in}$ applied to the first converter 113 or the input current $I_{in}$, and the duty ratio of the switching element Q2. The input voltage $V_{in}$ or the input current $I_{in}$ may be determined by the characteristics of the dimmer 220 and the transformer 230 included in the existing lighting facilities. Therefore, for the plurality of the light emitting devices 400 to be stably operated, an LED driving device 100 which can operate stably with regard to diverse values of the input voltage $V_{in}$ or the input current $I_{in}$ is required.

According to the present exemplary embodiment, by determining the reference voltage $V_{REF}$ from the value of the voltage $V_1$, and by comparing the reference voltage $V_{REF}$ to a sensing voltage $V_D$, the control circuit 120 may control an operation of the first converter 113, and the LED driving device 100 which can be widely applied to diverse combinations of the dimmer 220 and the transformer 230 may be implemented. As the output voltage $V_1$ is determined by a value of the input voltage $V_{in}$ or the input current $I_{in}$ applied to the first converter 113, the control circuit unit 120 may control the operation of the LED driving device 100 in accordance with characteristics of the dimmer 220 and the transformer 230 that are connected to the first converter 113 and that produce the input voltage $V_{in}$ and the input current $I_{in}$.

The detection circuit 123 may include a capacitor C1 and one or more resistors R4 and R5. One terminal of a capacitor C1 may be connected to an input terminal of an operational amplifier 127, such as an inverting terminal thereof in the present exemplary embodiment. The sensing voltage $V_D$ may correspond to a voltage across the capacitor C1 and may be generated by applying a current $I_{DS}$ flowing from a drain terminal through a source terminal of the switching element Q2 to the capacitor C1. The sensing voltage $V_D$ is compared with the reference voltage $V_{REF}$ applied to a non-inverting terminal of the operational amplifier 127, wherein the reference voltage $V_{REF}$ may be determined by the reference voltage control circuit 125.

The reference voltage control circuit 125 may include a Zener diode $Z_D$ inversely connected to the input terminal of circuit 125 that receives the output voltage $V_1$ of the first converter 113, resistors R1, R2, and R3, a switching element Q1, and resistors $R_{D1}$ and $R_{D2}$ operating as a voltage distribution circuit for generating a constant voltage. The voltage distribution circuit may include the resistors $R_{D1}$ and $R_{D2}$, and a first voltage source $V_{cc}'$ applying a voltage $V_{cc}'$ across the series connection of resistors $R_{D1}$ and $R_{D2}$.

For convenience of explanation, the present exemplary embodiment will be described using an example in which the switching element Q1 is a Bipolar Junction Transistor (BJT). The voltage $V_1$ is applied to a base terminal of the switching element Q1 (also referenced as a common terminal of the switching element Q1) through the resistor R1 and the Zener diode $Z_D$. A collector terminal of Q1 (also referenced as an output terminal of the switching element Q1) is connected to an input terminal of the operational amplifier and also connected to the terminal between the resistors $R_{D1}$ and $R_{D2}$, and an emitter terminal (also referenced as an input terminal of the switching element Q1) is connected to a second voltage source $V_{cc}$ through a resistor R3.

As a base voltage of the switching element Q1 is determined by the voltage $V_1$, the operating mode of the switching element Q1 is determined by the voltage $V_1$. For example, in a case in which the voltage $V_1$ is higher than a predetermined first threshold voltage $V_{th1}$, a reverse bias between the base terminal and the emitter terminal of the switching element Q1 is formed and the switching element Q1 may not operate, and the reference voltage $V_{REF}$ may be maintained at a same value as that of a voltage $R_{D2}*V_{CC}'/(R_{D1}+R_{D2})$ determined by the voltage distribution circuit. In this case, the current flowing through the second distribution resistor $R_{D2}$ is generated only by the voltage distribution circuit, and the reference voltage $V_{REF}$ may have the same value as the voltage $R_{D2}*V_{CC}'/(R_{D1}+R_{D2})$ applied to the second distribution resistor $R_{D2}$ by distributing the first voltage source $V_{CC}'$ across resistors $R_{D1}$ and $R_{D2}$.

Meanwhile, in a case in which the voltage $V_1$ is lower than a predetermined second threshold voltage level $V_{th2}$, the switching element Q1 operates in a conductive state. As a result, the reference voltage $V_{REF}$ may increase as the current flowing through the resistor $R_{D2}$ is determined by adding the current flowing by the resistor $R_{D1}$ of the voltage distribution circuit and the collector current $I_C$ of the switching element Q1. In this case, the predetermined second threshold voltage level $V_{th2}$ is lower than the voltage of the predetermined first threshold voltage level $V_{th1}$, and may correspond to a minimum voltage at which the second converter 115 may operate normally and allow the plurality of the light emitting devices 400 to emit light. In a case in which the output $V_1$ is lower than $V_{th1}$ and higher than $V_{th2}$, the switching element Q1 operates, and the reference voltage $V_{REF}$ may be determined by a collector voltage determined by multiplying a collector current $I_c$ and resistance of the resistor $R_{D2}$ and a voltage applied to a resistor $R_{D2}$ by the voltage distribution circuit, similar to the case in which the voltage $V_1$ is lower than the second threshold voltage level $V_{th2}$.

Operation of the circuit 120 in a case in which the output $V_1$ is lower than the predetermined first threshold voltage level $V_{th1}$ will now be described. With reference to FIG. 3, the reference voltage $V_{REF}$ applied to a non-inverting terminal of the operational amplifier may be affected by a current flowing through a resistor $R_{D2}$, that is, the collector current of the switching element Q1, and may be determined by a collector voltage $V_C$ of the switching element Q1. The base voltage applied to a base terminal of the switching element Q1 increases proportionally to $V_1$. As a base voltage of the switching element Q1 increases according to the operation characteristics of the switching element Q1, a collector current and a collector voltage $V_c$ may be decreased.

In a case in which an output voltage $V_1$ of the first converter 113 increases, a high voltage is reversely applied to the Zener diode $Z_D$, the current flowing through the resistor R1 increases, and a voltage applied to the base terminal of the switching element Q1 increases. Accordingly, the collector current $I_c$ of the switching element Q1 may be decreased as the base voltage of the switching element Q1 increases. The level of the reference voltage $V_{REF}$ applied to a non-inverting terminal of the operational amplifier may be determined by adding the voltage $R_{D2}*V_{CC}'/(R_{D1}+R_{D2})$ determined by the resistor $R_{D1}$ and $R_{D2}$ at the voltage distribution circuit and the voltage $R_{D2}*I_c$ generated by a collector current $I_c$ flowing out of the collector of Q1 and through the resistor $R_{D2}$. That is, the reference voltage $V_{REF}$ may be determined according to Equation 1 as below:

$$V_{REF} = \frac{R_{D1} * V_{CC}'}{R_{D1} + R_{D2}} + I_C * R_{D2} \quad \text{[Equation 1]}$$

In other words, the referenced voltage $V_{REF}$ may be increased or decreased according to an operation of the switching element Q1. In detail, as the reference voltage $V_{REF}$ may be determined according to a collector current $I_c$ of the switching element Q1, and the collector current $I_c$ may be determined according to the voltage $V_2$ determining the base voltage of the switching element Q1, the reference voltage $V_{REF}$ may be increased or decreased according to a change of the voltage $V_1$. In addition, as the magnitude of the collector current $I_c$ may be varied according to an emitter current of the switching element Q1, the fluctuation width defined as the difference between a maximum value and a minimum value of the reference voltage $V_{REF}$ may be determined by resistor $R_3$ determining the emitter current.

The collector terminal of the switching element Q1 is connected between the resistors $R_{D1}$ and $R_{D2}$ included in the voltage distribution circuit, and the collector current and the collector voltage of the switching element Q1 may be proportional to each other. When an output voltage $V_1$ of the first converter 113 increases, the collector voltage decreases due to the decrease in collector current $I_C$ in the switching element Q1. In conclusion, as the collector voltage $Ic*R_{D2}$ which determines the reference voltage $V_{REF}$ by being added with the constant voltage $R_{D2}*V_{CC}'/(R_{D1}+R_{D2})$ decreases, the reference voltage $V_{REF}$ decreases. Accordingly, as the duty ratio of the switching element Q2 decreases, the output voltage $V_1$ of the converter 113 decreases, and the current $I_{LED}$ which the second converter 115 outputs to the plurality of LEDs also decreases, such that the luminescence of the light emitting device decreases.

Meanwhile, in a case in which the output voltage $V_1$ of the first converter 113 decreases, as the base voltage applied to the base of the switching element Q1 decreases, the collector current $I_C$ of the switching element Q1 increases, and the collector voltage defined as $Ic*R_{D2}$ also increases. Accordingly, the reference voltage $V_{REF}$, defined as the sum of the collector voltage of the switching element Q1 and the constant voltage $R_{D2}*V_{CC}'/(R_{D1}+R_{D2})$, increases, and the duty ratio of the switching element Q2 increases, such that the energy accumulated at the inductor L1 increases. Thus, the output voltage $V_1$ of the converter 113 increases and the current $I_{LED}$ supplied to the plurality of LEDs is increased as well.

That is, in a case in which the output voltage $V_1$ of the first converter 113 decreases, the operation of the first converter 113 is controlled to increase the voltage $V_1$, while in a case in which the output voltage $V_1$ of the first converter 113 increases, the operation of the first converter 113 is controlled to decrease the voltage $V_1$. In other words, the operation of the first converter 113 is controlled to operate the light emitting device 400 to be relatively brighter when $V_1$ has a lower value, and the operation of the first converter 113 is controlled to operate the light emitting device 400 to be relatively darker or dimmer when $V_1$ has a higher value. Accordingly, although a light emitting device is connected to the dimmer 220 and the transformer 230 which outputs a voltage $V_{in}$ or a current $I_{in}$ at a very high or very low level, the LED driving device 100 may guarantee an operation of the light emitting device 400 at a certain level of performance. On the contrary, in a case in which a light emitting device is connected to the dimmer 220 and the transformer 230 which outputs a voltage $V_{in}$ or a current $I_{in}$ at a very high level, the LED driving device 100 may be controlled to reduce stress applied to the power converter 110 and the light emitting unit 300, thereby enhancing reliability thereof.

Meanwhile, as the level of the output voltage $V_1$ is varied according to the magnitude of the input electric signal due to the characteristics of the first converter 113 operating as a constant converter, the magnitude of an electric signal applied to an input of the LED driving device 100, that is, the magnitude of electricity output from a transformer 230 of a lighting apparatus, may be detected by sensing the output voltage $V_1$ of the first converter 113. According to the present exemplary embodiment, the characteristics of the first converter 113 may be determined according to a magnitude of electric power output from the transformer 230 of a lighting apparatus. By detecting the output voltage $V_1$ from the first converter 113, the magnitude of electric power output from the transformer 230 may be identified, and the level of output voltage $V_1$ may be increased or decreased. Accordingly, the LED driving device 100 can be used in applications having a magnitude of electric power within a wide output range.

Figure 4A:
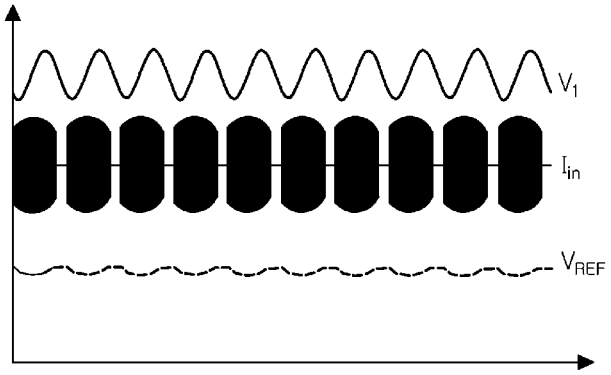
FIGS. 4A and 4B are graphs schematically illustrating the operation of a lighting device including an LED driving device according to an exemplary embodiment of the present disclosure.
Figure 4B:
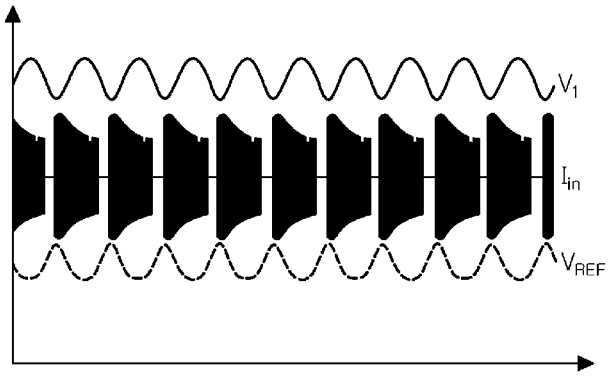

FIGS. 4A and 4B are graphs schematically illustrating an operation of a lighting device including an LED driving device according to an exemplary embodiment of the present disclosure.

FIG. 4A illustrates a case in which the reference voltage $V_{REF}$ is maintained to be constant, regardless of a level fluctuation of an input current $I_{in}$ and an output voltage $V_1$ of the first converter 113. FIG. 4B illustrates a case in which the reference voltage $V_{REF}$ is controlled according to a level of the input current $I_{in}$ and the output voltage $V_1$ of the first converter 113, as shown in FIG. 3.

With reference to FIG. 4A, the level of the output voltage $V_1$ of the first converter 113 is, for example, Root Mean Square (RMS) of 24.35V, and a peak-to-peak level of 5.4V. Meanwhile, the reference voltage $V_{REF}$ may be maintained at a constant value without large fluctuation, and in this case, an input current $I_{in}$ applied to the first converter 113 has a peak-to-peak level of 3.866 A. In a case in which $V_{REF}$ is maintained regardless of the output voltage $V_1$ of the first converter 113, the range of fluctuation of the input current $I_{in}$ applied to the first converter 113 is limited to 3.866 A based on peak-to-peak value.

With reference to FIG. 4B, the reference voltage $V_{REF}$ applied to a non-inverting terminal of an operational amplifier is varied according to fluctuation of an output voltage $V_1$. As described above, from the results of the simulation of FIG. 4B, it is identified that $V_{REF}$ decreases as $V_1$ increases and $V_{REF}$ increases as $V_1$ decreases.

In detail, for example, in the graph of FIG. 4B, the output voltage $V_1$ of the first converter 113 has a peak-to-peak value of 4.896V, and the reference voltage $V_{REF}$ has a RMS value of 246.7 mV and a peak-to-peak value of 177.02 mV, in connection with the voltage $V_1$. Meanwhile, the input current $I_{in}$ applied to the first converter 113 has a peak-to-peak value of 5.705 A. By controlling $V_{REF}$ to be increased or decreased according to the output voltage $V_1$, the first converter 113 may be controlled more stably within a range of the input current $I_{in}$ wider than that shown in the graph of FIG. 4A.

By flexibly determining a value of $V_{REF}$ according to $V_1$ as above, the current $I_{LED}$ applied to an LED included in the lighting unit 300 can advantageously be precisely set for diverse input conditions. A value of the voltage $V_{in}$ and the current $I_{in}$ output from a transformer or a dimmer for a halogen lamp or a fluorescent lamp may be determined by a specification of the transformer or the dimmer, and may have differing values according to manufacturers. Therefore, it is advantageous to control the first converter 113 to output the voltage $V_1$ which can stably operate the lighting unit 300 at a wider range of the voltage $V_{in}$ or the current $I_{in}$.

According to the present exemplary embodiment, the LED driving device 100 may control the first converter 113 to stably generate an output voltage $V_1$ by using a wider range of the input voltage $V_{in}$ and the input current $I_{in}$ by detecting a level of output voltage $V_1$ determined according to input conditions of the first converter 113, thereby controlling the level of $V_{REF}$. Accordingly, the LED driving device 100 according to the present exemplary embodiment may be applied to diverse combinations of the dimmer 220 and the transformer 230, and the application may also be applied to a lighting device 200 equipped with the LED driving device 100.

Figure 5:
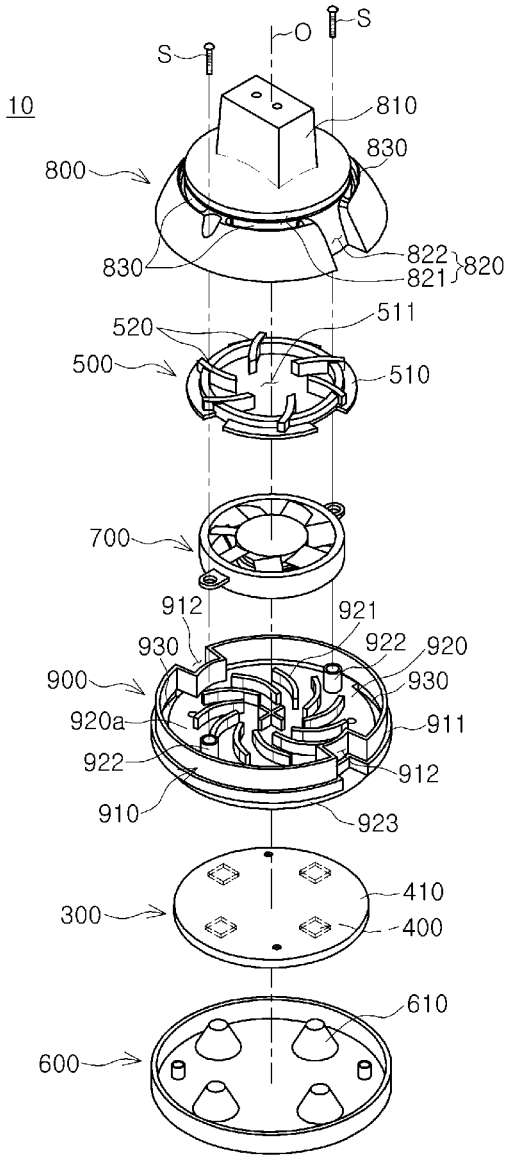
FIGS. 5, 6, and 7 are perspective views schematically illustrating lighting devices according to exemplary embodiments of the present disclosure.
Figure 6:
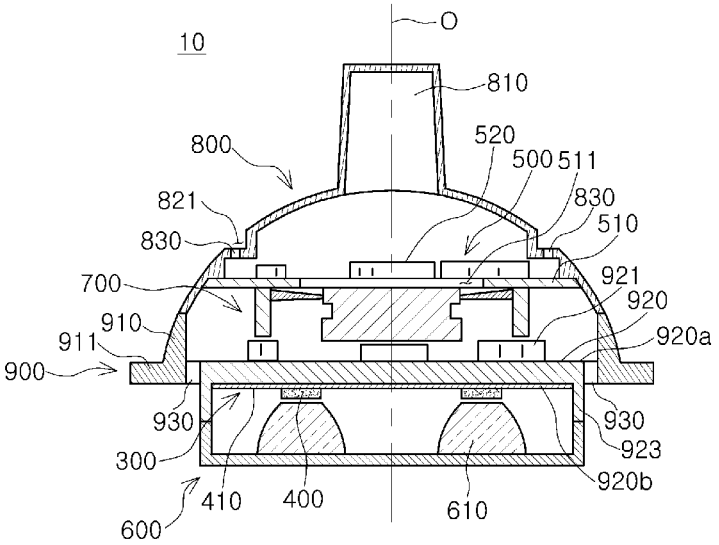
Figure 7:
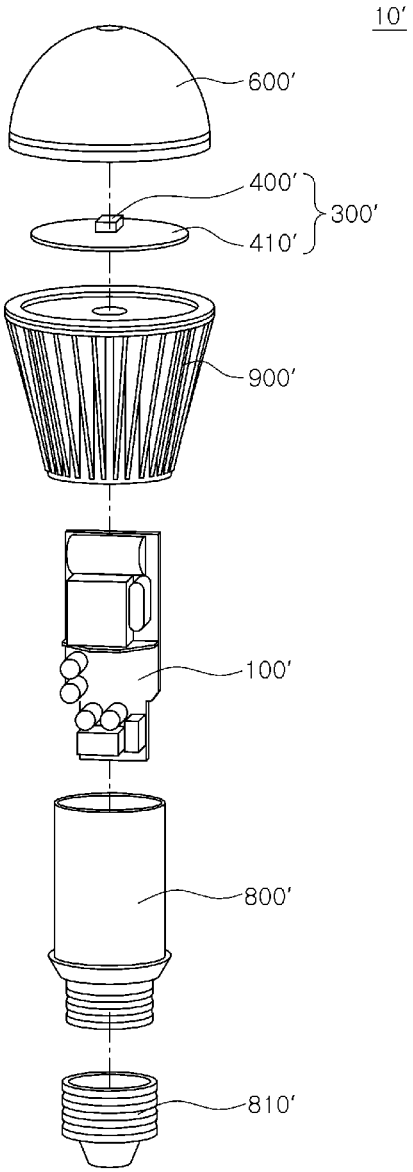

FIGS. 5 to 7 are exploded perspective views schematically illustrating a lighting device according to an embodiment of the present disclosure. In FIGS. 5 and 6, a lamp according to the MR16 standard is illustrated as a lighting device according to the present embodiment, but the lighting device according to an embodiment of the present disclosure is not limited thereto.

Referring to FIGS. 5 and 6, a lighting device 10 according to the present embodiment may include a base 900, a housing 800, a cooling fan 700, and a light emitting unit 300.

The base 900 is a type of frame member in which the cooling fan 700 and the light emitting unit 300 are fixedly installed. The base 900 may include a fastening rim 910 and a support plate 920 provided within the fastening rim 910.

The fastening rim 910 may have an annular structure perpendicular with respect to a central axis O, and may have a flange portion 911 outwardly protruded from a lower end portion thereof. When the lighting device 10 is installed in a structure such as a ceiling, the flange portion 911 may be inserted into a hole provided in the ceiling to fix the lighting device 10 therein.

The fastening rim 910 may have a recess 912 formed to be depressed in a direction toward a central portion of the base 900. The recess 912 may have a shape corresponding to that of a flow path 820 of a housing 800 as described hereinafter, and may be formed in a position corresponding to the flow path 820. Accordingly, the flow path 820 is formed with the recess 912 in a continued manner so as to be exposed outwardly through a lower portion of the fastening film 910.

The base 900 employed in the present embodiment will now be described in detail. The support plate 920 may be provided in an inner circumferential surface of the fastening rim 910 and have a horizontal structure perpendicular with respect to the central axis O, and may be partially connected to the fastening rim 910. The support plate 920 may have one surface (or an upper surface) 920*a* and the other opposite surface (or a lower surface) 920*b* which are flat and oppose each other, and may include a plurality of heat dissipation fins 921 formed on one surface 920*a* thereof. The plurality of heat dissipation fins 921 may be arranged radially from the center of the support plate 920 toward the edges thereof. In this case, the plurality of heat dissipation fins 921 may each have curved surfaces and have an overall spiral shape. In the present embodiment, the plurality of heat dissipation fins 921 are illustrated as each having a curved surface and being arranged in a spiral manner, but the present disclosure is not limited thereto and the heat dissipation fins 921 may have various other shapes such as a linear shape, and the like.

Fixing portions 922 may be formed to be protruded to a predetermined height from the one surface 920*a*. The fixing portions 922 may have a screw hole formed therein to allow the housing 800 and the cooling fan 700 as described hereafter to be fixed thereto using fixing units such as screws S, or the like.

The light emitting unit 300 is installed on the other surface 920*b* of the support plate 920. A side wall 923 protruded from the other surface 920*b* in a downward direction and having a predetermined height may be provided along the circumference of the edges. A recess having a predetermined size may be provided within the side wall 923 to accommodate the light emitting unit 300 therein.

An air discharge hole 930 in the form of a slit may be provided between an outer circumferential surface of the support plate 920 and an internal surface of the fastening rim 910. The air discharge hole 930 may serve as a passage through which air is released from the one surface 920*a* toward the other surface 920*b*, thus allowing a continuous flow of air to be maintained without the air being stagnant in the one surface 920*a*.

The base 900 is directly in contact with the light emitting unit 300, a heat source, so it may be made of a material having excellent heat conductivity to perform a heat dissipation function such as that of a heat sink. For example, the base 900 may be formed of a metal, a resin, or the like, having excellent heat conductivity such that the fastening rim 910 and the support plate 920 may be integrated through injection molding, or the like. Also, the fastening rim 910 and the support plate 920 may be manufactured as separate components and assembled. In this case, the support plate 920 may be made of a metal, a resin, or the like, having excellent heat conductivity, while the fastening rim 910 that the user directly grasps in case of an operation such as replacement of a lighting device, or the like, may be made of a material having relatively low heat conductivity, in order to prevent burns or other damage due to heat.

As illustrated in FIGS. 5 and 6, the housing 800 may be disposed on one side of the base 900. Specifically, the housing 800 is fastened to the fastening rim 910 to cover the support plate 920. The housing 800 may have an upwardly convex parabolic shape, and a terminal portion 810 may be provided in an upper end portion of the housing 800 to be fastened to an external power source (e.g., a socket), while an opening may be formed in a lower end portion thereof to be fastened to the base 900. In particular, the housing 800 may include the flow path 820 as a depressed region forming a step with respect to an external surface of the housing 800 to guide an inflow of air from the outside and an air inflow hole 830 allowing air guided through the flow path 820 to be introduced to an internal surface.

The air inflow holes 830 may be formed along the circumference of the housing 800 in an annular shape and be adjacent to an upper end portion of the housing 800. At least one flow path 820 may have a depressed structure in the form of a recess and be formed on an outer surface of the housing 800. The flow path 820 may extend upwardly along the outer surface of the housing 800 to communicate with the air inflow hole 830.

In detail, the flow path 820 may include a first flow path 821 formed along the circumference of the housing 800 in a position corresponding to the air inflow hole 830 to communicate with the air inflow hole 830 and a second flow path 822 extending from the first flow path 821 to a lower end portion of the housing 800 to be opened to the outside. The second flow path 822 may be formed with the recess 912 of the fastening rim 910 fastened to the lower end portion of the housing 800 in a continual manner, and may extend to a lower portion of the fastening rim 910 to be opened to the outside. Accordingly, ambient air may be introduced along the flow path 820 as a portion of the outer surface of the housing 800 and guided in an upward direction from a lower side of the fastening rim 910, and may be introduced to an internal space of the housing 800 through the air inflow hole 830. The present embodiment illustrates a pair of second flow paths 822 facing each other, but the number of second flow paths 822 and positions thereof may be variously modified.

FIG. 7 is an exploded perspective view illustrating an example in which a light emitting device package according to an embodiment of the present disclosure is applied to a lighting device.

Referring to the exploded perspective view of FIG. 7, a lighting device 10' is illustrated as a bulb type lamp by way of example, including a light emitting unit 300', a driving unit 100', and an external connection unit 810'. Also, the lighting device 10' may further include external structures such as a housing 800' and a cover unit 600'. The light emitting unit 300' may include a light emitting device 400' having the LED package structure or any structure similar thereto and a substrate 410' on which the light emitting device 400' is mounted. In the present embodiment, a single light emitting device 400' is illustrated as being mounted on the substrate 410', but the present disclosure is not limited thereto and a plurality of light emitting devices 400' may be mounted as necessary.

Heat generated by the light emitting device 400' may be dissipated through a heat dissipation unit, and a heat sink 900' may be provided in direct contact with the light emitting unit 300' to enhance a heat dissipation effect in the lighting device 100' according to the present embodiment. The cover unit 600' may be installed on the light emitting unit 300' and have a convex lens shape. The driving unit 100' may be installed in the housing 800' and connected to an external connection unit 810' having a socket structure to receive power from an external power source. Also, the driving unit 100' may convert received power into an appropriate current source for driving the light emitting device 400' included in the light emitting unit 300' and provide the same. For example, the driving unit 100' may include the circuits or devices described above with reference to FIGS. 1 to 3 and the like. In addition, the lighting device 10' may further include a communications module as explained above.

While exemplary embodiments have been shown and describe above, it will be apparent to those skilled in the art that modifications and variations can be made without departing from the spirit and scope of the invention as defined by the appended claims.

What is claimed is:

1. An LED driving device, comprising:

a first converter generating a first voltage from received alternating current (AC) power;

a second converter receiving the first voltage and driving a plurality of LEDs based on the received first voltage; and a control circuit setting a reference voltage level based on a level of the first voltage received by the second converter, and controlling the level of the first voltage by comparing a level of the AC power and a level of the reference voltage, wherein the control circuit decreases the level of the reference voltage when the level of the first voltage increases, and increases the level of the reference voltage when the level of the first voltage decreases.

2. The LED driving device of claim 1, wherein the control circuit includes:

a detection circuit generating a sensing voltage corresponding to the level of the AC power by detecting a current flowing through an inductive element in the first converter;

a reference voltage control circuit determining the level of the reference voltage based on the first voltage; and a comparison circuit comparing the level of the reference voltage with a level of the sensing voltage.

3. The LED driving device of claim 2, wherein the reference voltage control circuit of the control circuit decreases the level of the reference voltage if the level of the first voltage increases, and increases the level of the reference voltage if the level of the first voltage decreases.

4. The LED driving device of claim 2, wherein the comparison circuit controls the first voltage by controlling a duty ratio of a switching element connected to the inductive element based on a result of comparing the reference voltage and the sensing voltage.

5. The LED driving device of claim 2, wherein the reference voltage control circuit maintains the reference voltage at a constant level when the level of the first voltage is higher than a first threshold voltage level, and increases the reference voltage when the level of the first voltage is lower than a second threshold voltage level.

6. The LED driving device of claim 5, wherein the reference voltage control circuit controls the reference voltage according to the level of the first voltage when the level of the first voltage is lower than the first threshold voltage level and higher than the second threshold voltage level.

7. A lighting device, comprising:

a power source generating an alternating current (AC) power;

a lighting unit having a plurality of LEDs;

a power converter generating a first voltage for driving the plurality of LEDs by using the AC power; and a control circuit determining a reference voltage based on the first voltage and controlling the first voltage by comparing a level of the reference voltage and a voltage level of the AC power, wherein the control circuit decreases the level of the reference voltage when the level of the first voltage increases, and increases the level of the reference voltage when the level of the first voltage decreases.

8. The lighting device of claim 7, wherein the control circuit controls the level of the first voltage by controlling a duty ratio of a switching element of the power converter based on a result of comparing a voltage level of the AC power and the reference voltage.

9. The lighting device of claim 7, wherein the power source includes:

a dimmer; and a ballast stabilizer for a fluorescent lamp, connected to the dimmer and generating the AC power.

10. The lighting device of claim 7, wherein the control circuit includes:

a detection circuit generating a sensing voltage corresponding to the level of the AC power by detecting a current flowing through an inductive element in the converter;

a reference voltage control circuit determining the level of the reference voltage based on the first voltage; and a comparison circuit comparing the levels of the reference voltage and the sensing voltage.

11. The lighting device of claim 10, wherein the reference voltage control circuit includes a switching element determining the reference voltage, and the switching element is operated by the first voltage.

12. The lighting device of claim 11, wherein the reference voltage control circuit includes a resistor connected to an input terminal of the switching element, and the reference voltage is determined according to a value of the resistor.

13. A control circuit of an LED driving device driving a plurality of LEDs by receiving an output from a ballast stabilizer for a fluorescent lamp, comprising:

a detection circuit generating a sensing voltage corresponding to an output of the ballast stabilizer for a fluorescent lamp by detecting a current flowing through an inductive element included in the LED driving device;

a reference voltage control circuit determining a reference voltage based on a first voltage generated by the LED driving device; and a comparison circuit controlling the first voltage by comparing the sensing voltage and the reference voltage, wherein the control circuit decreases the current supplied to the plurality of LEDs when the first voltage increases, and the control circuit increases the current supplied to the plurality of LEDs when the first voltage decreases.

14. The control circuit of the LED driving device of claim 13, wherein the comparison circuit controls an operation of a switching element connected to the inductive element responsive to a comparison of the sensing voltage and the reference voltage.

15. The control circuit of the LED driving device of claim 14, wherein when the first voltage increases, the control circuit decreases the current supplied to the plurality of LEDs by decreasing a duty ratio of the switching element by decreasing the reference voltage, and when the first voltage decreases, the control circuit increases the current supplied to the plurality of LEDs by increasing the duty ratio of the switching element by increasing the reference voltage.

16. The control circuit of the LED driving device of claim 14, wherein the switching element includes a gate terminal connected to an output terminal of the comparison circuit, a drain terminal connected to the inductive element, and a source terminal connected to an output terminal of the detection circuit.

17. The control circuit of the LED driving device of claim 13, wherein the reference voltage control circuit includes:

a switching element having a common terminal, an input terminal, and an output terminal;

a Zener diode, wherein the first voltage is applied to an anode thereof and a cathode thereof is connected to the common terminal of the switching element;

a voltage distribution circuit having a first distribution resistor connected between the output terminal of the switching element and a predetermined first voltage source, and a second distribution resistor connected between the output terminal of the switching element and a ground terminal; and a resistor connected between the input terminal of the switching element and a predetermined second voltage source.

18. The control circuit of the LED driving device of claim 17, wherein the reference voltage control circuit determines the reference voltage according to the value of the resistor connected between the input terminal of the switching element and the predetermined second voltage source.

19. The control circuit of the LED driving device of claim 17, wherein when the first voltage is higher than a predetermined threshold voltage level, the reference voltage control circuit determines a voltage applied to the second distribution resistor as the reference voltage.

* * * * *